United States Patent [19]

Keidar et al.

[11] Patent Number: 4,969,478

[45] Date of Patent: Nov. 13, 1990

[54] PORTABLE CIGARETTE ASHTRAY

[76] Inventors: Itzhak Keidar, 19 Chisin Street; Asher Dromi, 11 Shderot Yotzer, both of Tel Aviv; Menahem Tilman, 34 Shaldag Street, Hofit, all of Israel

[21] Appl. No.: 332,142

[22] Filed: Apr. 3, 1989

[51] Int. Cl.[5] ..... A24D 1/12

[52] U.S. Cl. ..... 131/231; 131/237; 206/246

[58] Field of Search ..... 131/231, 329, 237, 235.1, 131/236; 206/246, 567; 211/88, 168, 163, 165; 4/258, 259, 264, 667

[56] References Cited

U.S. PATENT DOCUMENTS

| | | | |
|---|---|---|---|
| 1,912,598 | 6/1933 | Snadden | 131/237 |
| 2,989,964 | 6/1961 | Willett | 131/237 |
| 3,052,346 | 9/1962 | Maron | 206/246 |
| 4,047,615 | 9/1977 | Browne | 211/88 |
| 4,676,544 | 6/1987 | Dabringhaus | 131/231 X |
| 4,789,059 | 12/1988 | Kim | 206/246 |

FOREIGN PATENT DOCUMENTS

| | | | |
|---|---|---|---|
| 726127 | 5/1932 | France | 131/231 |
| 342200 | 7/1936 | Italy | 131/237 |

*Primary Examiner*—V. Millin
*Assistant Examiner*—Jennifer L. Doyle
*Attorney, Agent, or Firm*—Benjamin J. Barish

[57] ABSTRACT

A non-spillable portable cigarette ashtray has an ash receptacle open at its top, and a holder also having an open top and a flat bottom supporting the ashtray in an upright position. The ashtray is pivotally mounted to the holder and includes a weight which is effective, should the holder inadvertently be moved to a non-upright position, to cause the ash receptacle to pivot and to remain in an upright position, thereby preventing spilling out of the contents of the ash receptacle.

15 Claims, 1 Drawing Sheet

FIG 1
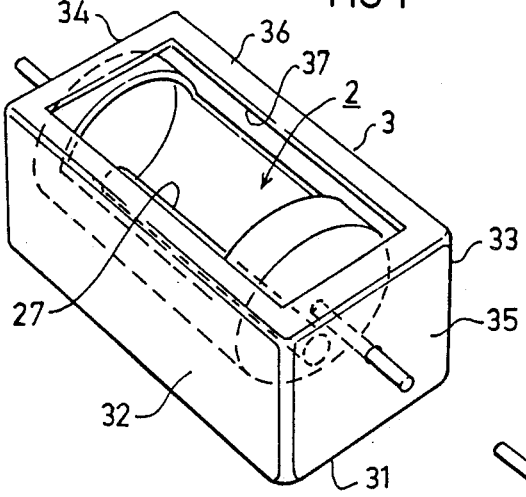
FIG 2
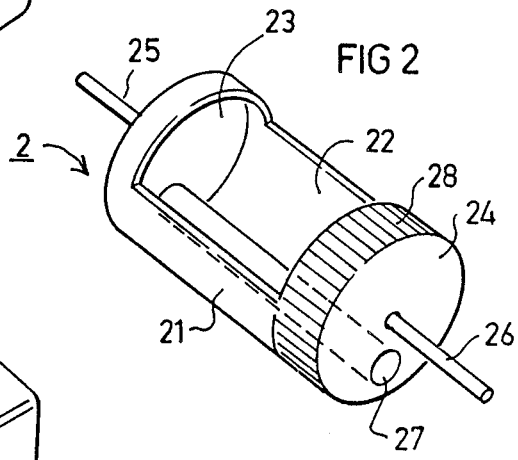
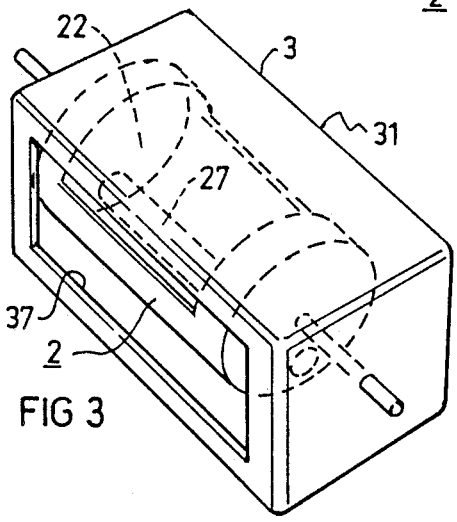
FIG 3
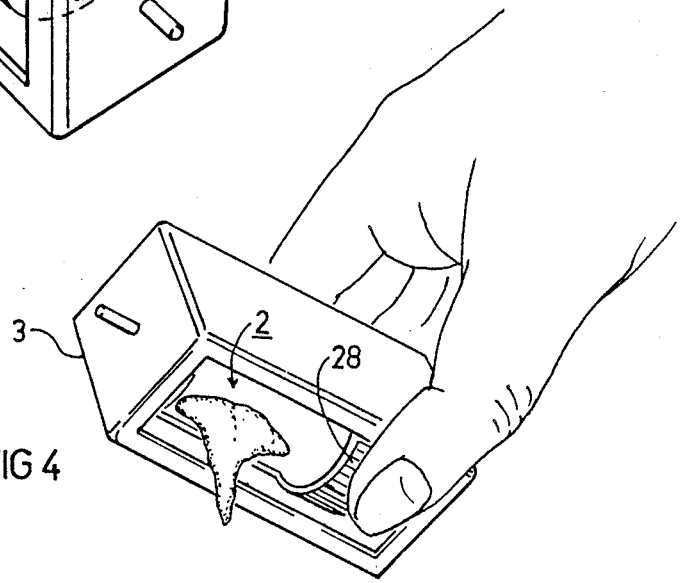
FIG 4

PORTABLE CIGARETTE ASHTRAY

BACKGROUND OF THE INVENTION

The present invention relates to cigarette ashtrays, and particularly to small, portable ashtrays for receiving the ashes from a cigarette, cigar or the like.

Many different types of portable cigarette ashtrays are in use. One of the drawbacks of the conventional ashtray construction is that should the ashtray be inadvertently turned on its side, it will spill out its contents. An object of the present invention is to provide a cigarette ashtray, particularly a portable one, which will not spill out its contents should it be inadvertently turned on its side.

BRIEF SUMMARY OF THE INVENTION

According to the present invention, there is provided a portable cigarette ashtray comprising: an ash receptacle open at the top and closed at its sides and bottom for receiving the ashes from a cigarette, cigar or the like; a holder for normally supporting itself and the ash receptacle in an upright position with the open end of the ash receptacle facing upwardly; a pivotal mounting between the ash receptacle and the holder permitting the ash receptacle to pivot about a horizontal axis; and a weight carried by the ash receptacle below its pivotal mounting and effective, should the holder be inadvertently moved to a non-upright position, to cause the ash receptacle to pivot within the holder and to remain in a upright position, and thereby to prevent spilling out the contents of the ash receptacle.

According to an additional feature of the invention, the ash receptacle further includes a fingerpiece normally aligned,with the open end of the holder enabling a user to press a finger against the fingerpiece and thereby to prevent pivoting of the ash receptacle when the user wishes to invert the ash receptacle in order to empty it of its contents.

It will thus be seen that an ashtray constructed in accordance with the foregoing features will not spill out its contents should it be inadvertently toppled and yet will permit a user to empty its contents with ease.

Further features and advantages of the invention will be apparent from the description below.

BRIEF DESCRIPTION OF THE DRAWINGS

The invention is herein described, by way of example only, with reference to the accompanying drawings, wherein;

FIG. 1 illustrates one form of ashtray constructed in accordance with the present invention;

FIG. 2 more particularly illustrates the construction of the ash receptacle in the device FIG. 1;

FIG. 3 illustrates the device of FIG. 1 when toppled on its side; and

FIG. 4 illustrates the manner of emptying the ash receptacle in the device of FIG. 1.

DESCRIPTION OF PREFERRED EMBODIMENTS

The portable cigarette ashtray illustrated in FIGS. 1–4 of the drawings comprises two main components, namely an ash receptacle, generally designated 2, and an outer holder, generally designated 3, pivotally mounting within it the ash receptacle.

The ash receptacle 2 is of generally cylindrical configuration, including a cylindrical side wall 21 formed with a cutout to define an open top 22, and circular end walls 23 and 24. The ash receptacle 2 is pivotally mounted within holder 3 by a pair of pivot pins 25, 26 secured to the two end walls 23, 24 and pivotally received within holes formed in the corresponding end walls of the outer holder 3. Ash receptacle 2 further includes a weight 27 integrated into its bottom.

Ash receptacle 2 further includes a fingerpiece 28 at one end engageable by the finger of the user when emptying the ashtray, as will be described more particularly below. In the illustrated construction, fingerpiece 28 is merely in the form of a knurled formation bordering one end of the opening 22 and extending around the circumference of the ash receptacle.

The outer holder 3 is of cubical configuration, being formed with six flat rectangular walls 31–36, namely bottom wall 31, side walls 32, 33, end walls 34, 35, and top wall 36. Top wall 36 is formed with a rectangular cutout to define an opening 37 which, in the upright position of the holder as illustrated in FIG. 1, is in alignment with the open end 22 of the ash receptacle 2 and is of larger dimensions than that of opening 22 and fingerpiece 28 of the ash receptacle 2.

In the normal use of the ashtray illustrated in FIGS. 1–4, the flat bottom 31 of holder 3 supports the holder, and the ash receptacle 2 within it, in an upright position as illustrated in FIG. 1, wherein both the opening 22 in the ash receptacle, and the opening 37 in the holder, face upwardly. Accordingly, the user may drop the ashes in the ash receptacle 2 in the conventional manner. The ashtray may also be carried with ease from one location to another.

Should the ashtray topple over to its side, as shown in FIG. 3, opening 37 of the outer holder 3 will move to the side, but the ash receptacle 2 will still remain in its upright position, with its open top 22 still facing upwardly, because of the weight 27 which causes the ash receptacle to pivot via its pivot pins 25, 26, with respect to the holder 3. Accordingly, even though the holder 3 has toppled to its side, the ash receptacle 22 will still remain in an upright position , thereby preventing spilling out of the contents of the ash receptacle.

Whenever it is desired to empty the contents of the ash receptacle, this may be conveniently done in the manner shown in FIG. 4. Thus, the user presses a finger against fingerpiece 28 of the ash receptacle 2, thereby preventing the ash receptacle from pivoting with respect to the holder 3, and then picks up the ashtray and inverts it to remove the contents from the ash receptacle 2.

In the above described embodiment, the ash receptacle 2 is pivotally mounted to the outer holder 3 substantially along the longitudinal axis of the ash receptacle. Such a construction requires the provision of a weight 27 below the pivotal mounting of the ash receptacle to the holder, preferably at the bottom of the ash receptacle. However, the pivotal mounting of the ash receptacle may be substantially above the longitudinal axis of the ash receptacle, preferably near its open top. In such an arrangement, the weight of the ash receptacle itself below its pivotal mounting constitutes the weight causing the ash receptacle to pivot about its pivotal mounting should the outer holder be toppled to its side.

While the invention has been described with respect to two preferred embodiments, it will be appreciated that many other variations, modifications and applications of the invention may be made.

What is claimed is:

1. A portable cigarette ashtray, comprising:

an ash receptacle open at the top and closed at its sides and bottom for receiving the ashes from a cigarette, cigar or the like;

a holder for normally supporting itself and the ask receptacle in an upright position with the open end of the ash receptacle facing upwardly;

said holder enclosing said ash receptacle and including an open top normally aligned with the open top of the ash receptacle, a flat bottom for stably supporting itself and the ash receptacle within it in an upright position on a flat horizontal surface, and flat side walls for stably supporting itself and the ash receptacle within it in a toppled position on a flat horizontal surface;

a pivotal mounting between the ash receptacle and the holder permitting the ash receptacle to pivot about a horizontal axis;

and a weight carried by the ash receptacle below its pivotal mounting and effective to cause the ash receptacle to pivot within the holder and to remain in a upright position, and thereby to prevent spilling out the contents of the ash receptacle, should the holder be inadvertently moved to a toppled position.

2. The ashtray according to claim 1, wherein said ash receptacle further includes a fingerpiece normally aligned with the open end of the holder enabling a user to press a finger against the fingerpiece and thereby prevent pivoting the ash receptacle when the user wishes to invert the ash receptacle in order to empty it of its contents.

3. The ashtray according to claim 2, wherein said fingerpiece is a knurled formation formed at one end of the ash receptacle.

4. The ashtray according to claim 1, wherein said ash receptacle is of cylindrical shape and has a substantially rectangular cutout at its top.

5. The ashtray according to claim 1, wherein said holder is of cubical shape and has a rectangular cutout aligned with, and of larger dimensions than, the open top of the ash receptacle.

6. The ashtray according to claim 1, wherein the ash receptacle is pivotally mounted to the holder substantially along the longitudinal axis of the ash receptacle.

7. A portable cigarette ashtray, comprising:

an ash receptacle open at its top and closed at its sides and bottom, for receiving the ashes from a cigarette, cigar or the like;

a holder enclosing said ash receptacle and having an open top aligned with the open top of the ash receptacle, said holder including a flat bottom for normally supporting itself and the ash receptacle in an upright position with the open top of the holder and ash receptacle facing upwardly;

a pivotal mounting between the ash receptacle and the holder permitting the ash receptacle to pivot about a horizontal axis;

and a weight carried by the ash receptacle below the pivotal mounting and effective, should the holder be inadvertently toppled to a non-upright position, to cause the ash receptacle to pivot within the holder and to remain in an upright position, and thereby to prevent spilling out the contents of the ash receptacle;

said ash receptacle further including a fingerpiece normally aligned with the open top of the holder at one side thereof and engageable by the finger of a user to prevent pivoting the ash receptacle when the user wishes to invert the ash receptacle in order to empty if of its contents.

8. The ashtray according to claim 7, wherein said fingerpiece is a knurled formation formed at one end of the ash receptacle.

9. The ashtray according to claim 7, wherein said ash receptacle has a cylindrical side wall, circular end walls, and an open top.

10. The ashtray according to claim 7, wherein said holder is of cubical shape having flat bottom, side and end walls, and an open top.

11. A portable cigarrette ashtray, comprising:

an ash receptacle open at the top and closed at its sides and bottom for receiving the ashes from a cigarette, cigar or the like;

a holder enclosing said ash receptacle and having a flat bottom and an open top in alignment with open top of the ash receptacle for normally supporting the ash receptacle and itself in an upright position with the open tops of both facing upwardly;

a pivotal mounting between the ash receptacle and the holder permitting the ash receptacle to pivot about a horizontal axis;

a weight carried by the ash receptacle below its pivotal mounting and effective, should the holder be inadvertently moved to a non-upright position, to cause the ash receptacle to pivot within the holder and thereby to remain in an upright position, to prevent spilling out of the contents of the ash receptacle;

and a fingerpiece fixed to the ash receptacle and normally aligned with the open top of the holder, when in an upright position, enabling a user to press a finger against the fingerpiece and thereby to prevent pivoting the ash receptacle when the user wishes to invert the ash receptacle in order to empty it of its contents.

12. The ashtray according to claim 11, wherein said fingerpiece is a knurled formation formed at one end of the ash receptacle and normally aligned with the open top of the holder.

13. The ashtray according to claim 11, wherein said ash receptacle has a cylindrical side wall, circular end walls, and an open top.

14. The ashtray according to claim 11, wherein said holder is of cubical shape having flat rectangular bottom, side and end walls, and an open top normally aligned with, and of larger dimensions than, the open top of the ash receptacle and its fingerpiece.

15. The ashtray according to claim 11, wherein the ash receptacle is pivotally mounted to the holder substantially along the longitudinal axis of the ash receptacle.

* * * * *